US006152004A

United States Patent [19]

Nispel

[11] Patent Number: 6,152,004

[45] **Date of Patent: *Nov. 28, 2000**

[54] APPARATUS FOR FORMING STACKS

[75] Inventor: Thomas Nispel, Dautphetal-Herzhausen, Germany

[73] Assignee: Bioforce Anstalt, Vaduz, Liechtenstein

[ * ] Notice: This patent issued on a continued prosecution application filed under 37 CFR 1.53(d), and is subject to the twenty year patent term provisions of 35 U.S.C. 154(a)(2).

[21] Appl. No.: 09/052,712

[22] Filed: Mar. 31, 1998

[30] Foreign Application Priority Data

Apr. 3, 1997 [DE] Germany ..... 197 13 813

[51] Int. Cl.[7] ..... B26D 7/32

[52] U.S. Cl. ..... 83/92; 83/155; 83/157; 83/932

[58] Field of Search ..... 83/92, 93, 85, 83/86, 90, 91, 155, 157, 932, 77, 167, 155.1

[56] References Cited

U.S. PATENT DOCUMENTS

| | | | |
|---|---|---|---|
| 2,381,016 | 8/1945 | Waage | 83/92 |
| 2,438,937 | 4/1948 | Metzler | 83/92 |
| 2,528,888 | 11/1950 | Klingens | 83/92 |
| 3,550,493 | 12/1970 | Benbenek | 83/92 |
| 4,405,186 | 9/1983 | Sandberg et al. | 83/92 |

*Primary Examiner*—Rinaldi I. Rada
*Assistant Examiner*—Melissa L Hall
*Attorney, Agent, or Firm*—Townsend and Townsend and Crew LLP

[57] ABSTRACT

An apparatus for the stack formation is described, by means of which a practically continuous individual stack formation is possible from a stream of slices produced by means of a cutting apparatus. For this purpose a partial stack is formed by means of a stack receiver, and is transferred for the further stack formation to a portioning band, so that, during the continuation of the stack formation on the portioning band, a return guidance of the stack receiver can take place into a position from which it can be shot anew into the stream of slices for the formation of a next partial stack.

6 Claims, 3 Drawing Sheets

APPARATUS FOR FORMING STACKS

BACKGROUND OF THE INVENTION

The invention relates to an apparatus for the forming of stacks of products cut up into slices in a rapid sequence, in particular food products, such as ham, sausage, cheese and the like, with a portioning band associated with a cutting device, in particular a slicer, and with a transport band, which takes over the respectively finished stack from the portioning band.

It is known to cut up food products to form slice stacks by means of slicers, i.e. cutting apparatuses with a high cutting frequency, with the height of fall of individual slices cut off from the product differing in dependence on the stack that is forming. This different height of fall leads to a situation in which no adequately precisely aligned vertical stack arises but rather, in relation to the transport band, which, as a rule, receives the stack and stands still during the stack formation, an offset arises in the direction of the transport band and also a lateral offset. The offset which occurs in the transport band direction can be counteracted by corresponding control of the transport band, but the lateral offset, which originates from a component of movement imparted to the respective slice by the cutting knife cannot be compensated, or can only be compensated by tolerating other disadvantages.

It is already known to effect the stack formation on a lowerable portioning band in order to achieve a substantially constant height of fall of individual slices. As the portioning band, after transfer of the finished stack to the transport band, must first be returned again into its starting position close to the knife for the formation of the next stack, comparatively long time intervals, in which empty cuts have to be executed, arise between the individual stack forming procedures, which leads to considerable performance penalties.

Furthermore, it is already known to use so-called paddle arrangements for the stack formation, which are lowered during the stack formation and which transfer the respectively finished stack onto a transport band. The known paddle arrangement is complicated construction-wise and not suitable to satisfy the requirements of high working speeds and working precision with the slicers which become ever more powerful.

SUMMARY OF THE INVENTION

The object of the invention is to design an apparatus of the initially named kind in such a way that even with very high cutting speeds a continuous stack formation is made possible and a lateral offset is at least extensively avoided during the stack formation.

This object is satisfied in accordance with the invention in that a stack receiver, which can be lowered during the forming of a partial stack, and can be returned into a waiting position close to the cutting knife after transfer of the partial stack onto the portioning band, is provided between the cutting device and the portioning band, in that the portioning band can be lowered in accordance with the further stack formation and at least between the partial stack takeover position and a finished stack transfer position, and in that the stack receiver can be shot out of the waiting position into the slice stream produced by the cutting device for the formation of the next respective partial stack.

As a result of the partial stack formation, which takes place by means of the stack receiver, and the return of the stack receiver, which takes place after transfer of the partial stack onto the portioning band, into a position from which it can be shot as fast as lightening at a predeterminable point in time into the slice stream, and thus the formation of a new partial stack takes place, no time loss required for the return guidance of the stack receiver need be tolerated, and this is a precondition that the stack formation can be carried out preferably free of empty cuts. A stack formation free of empty cuts also has the result that the cutting apparatus can be ideally operated and no stopping of the product feed or partial retraction of the product with respect to the cutting plane is necessary.

It is also of importance that by means of the apparatus of the invention, the same height of fall can be ensured for all the individual slices, and thus the height of fall can be selected to be minimal, because the stack formation which takes place via the stack receiver can take place directly adjoining the lowest position of the cutting edge of the knife.

The portioning band, onto which the partial stack formed by means of the stack receiver is transferred, is preferably formed as a belt band, into which the correspondingly adapted rake-like stack receiver drives and can transfer the partial stack onto the portioning band during this driving process. The further stack formation takes place up to completion of the final stack by corresponding lowering of the portioning band, with the lowering movements of the stack receiver and the portioning band corresponding to one another so that no change of the height of fall of the individual slices results during the formation of the total stack.

The lowering of the portioning band is preferably so designed that the portioning band can be acceleratedly lowered for a short time to enlarge the shoot-in gap for the stack receiver on reaching the position which corresponds to the finished stack. The size of this accelerated lowering can be kept small, because the stack receiver can, for example, be transferred via a spindle drive with a programmed movement sequence out of the waiting position into the active position within milliseconds.

It is furthermore particularly advantageous if the lowering stroke of the stack receiver is fixed and if the lowering stroke of the portioning band can be adjusted in dependence on the respectively required stack height, because in this manner the total sequence of movement of the stack receiver can be fixedly pregiven and the required variability with respect to the stack formation is nevertheless present.

DESCRIPTION OF THE PREFERRED EMBODIMENTS

Figure 1:
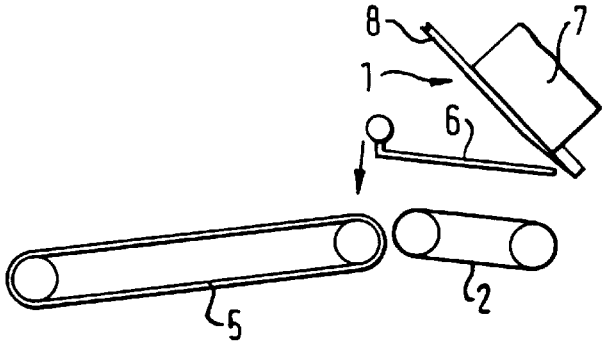
FIGS. 1 to 7 show in schematic manner, on the one hand, the basic construction of the apparatus of the invention and, on the other hand, the process of the stack formation in the sequence of the sequential operating states of the apparatus.

FIG. 1 shows in schematic manner a cutting apparatus 1 with a rotating scythe knife, or a rotating and simultaneously planetarily rotating knife 8, as well as a product 7 to be cut up, which is supplied via a customary product supply to the cutting plane. By means of such a cutting apparatus, also termed a slicer, which can have a slicing power of far beyond a thousand cuts per minute, a stream of downwardly falling individual slices is produced from the product to be cut up. In many cases slice stacks have to be formed from these individual slices, and the slices in the stack should, as a rule, be mutually aligned as precisely as possible so that no skewed positions of the stack result.

Beneath the cutting apparatus 1 a portioning band 2 is provided which, as a rule, comprises a so-called belt band, i.e. a plurality of individual, mutually spaced-apart belts guided around deflection rollers. The respective stack of slices must be formed on this portioning band 2. The portioning band 2 is adjustably designed with respect to its vertical position and also provided with a drive to transport away a finished stack. The portioning band 2 is followed by a transport band 5, which takes over the finished stack from the portioning band 2 .

A stack receiver 6 is provided between the cutting apparatus 1 and the portioning band 2 and is formed as a rake-like member and so dimensioned that it can dive between the individual belts of the portioning band 2.

The stack receiver 6 is movable in accordance with a predeterminable path of movement, which will be explained in detail during the description of the operation.

In FIG. 1 the stack receiver 6 and the portioning band 2 adopt their respective basic positions, with the stack receiver 6 being located fully within the path of movement of the slices cut off from the product 7, and with its knife side end being disposed in the direct vicinity of the lowest position of the cutting edge of the knife 8. At the start of the cutting up procedure the stack receiver 6 is lowered in the direction of the portioning band 2, and indeed with such speed that the height of fall of the individual slices remains at least substantially constant. In this respect a partial stack 3 is formed on the stack receiver 6—as is shown in FIG. 2.

Figure 2:
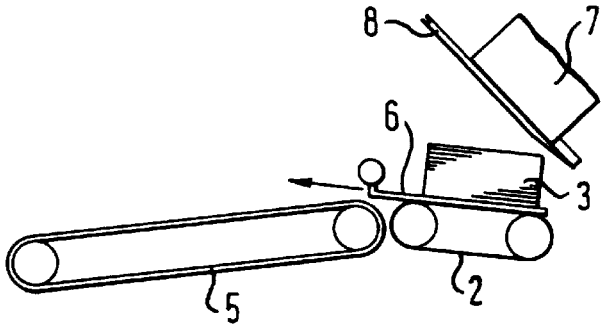
Figure 3:
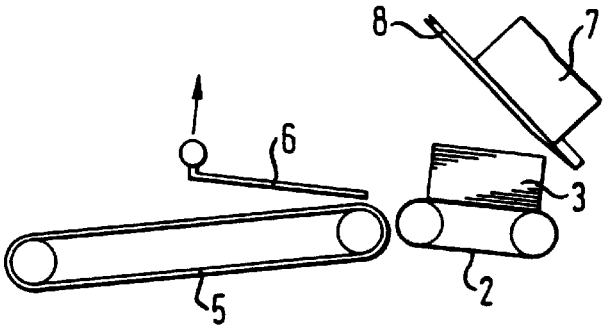
Figure 4:
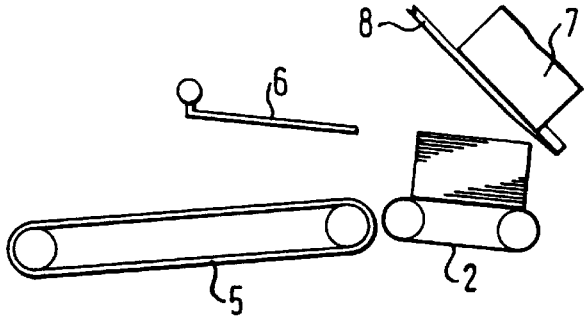
Figure 5:
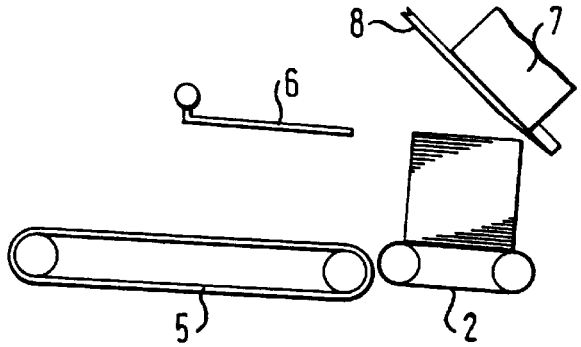

The size of the partial stack can be predetermined and the partial stack formation is finished when, in accordance with the representation in FIG. 2, the stack receiver 6 transfers the partial stack 3 onto the portioning band 2, so that it is free of the partial stack 3 and can be withdrawn in the direction of the arrow shown in FIG. 2 beneath the partial stack. From this moment on, the further stack formation takes place on the portioning band, which is now lowered with corresponding speed in order to keep the height of all of the individual slices constant. During the continuation of the stack formation on the portioning band 2, the stack receiver 6 is guided—as shown in FIG. 4—in the direction of the waiting position, which is shown in FIG. 5. In this position the stack receiver 6 can come to rest, with it being evident that adequate time is available for the return guidance of the stack receiver 6 into this rest position during the further stack formation.

Figure 6:
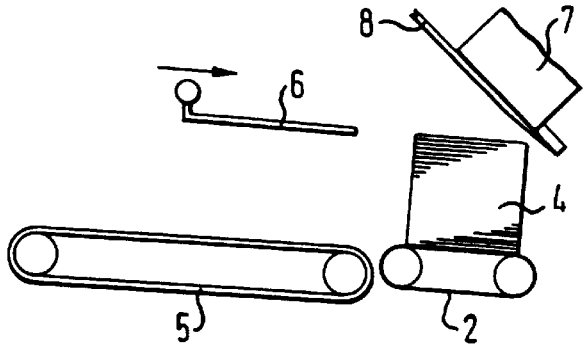

In FIG. 6 the point in time is shown at which the finished stack 4 is present on the portioning band 2 and the stack receiver 6 is shot in accordance with the illustrated arrow, with a very high speed, into the slice stream and reaches the original position shown in FIG. 1 within milliseconds, which corresponds to the start of the next partial stack formation.

Figure 7:
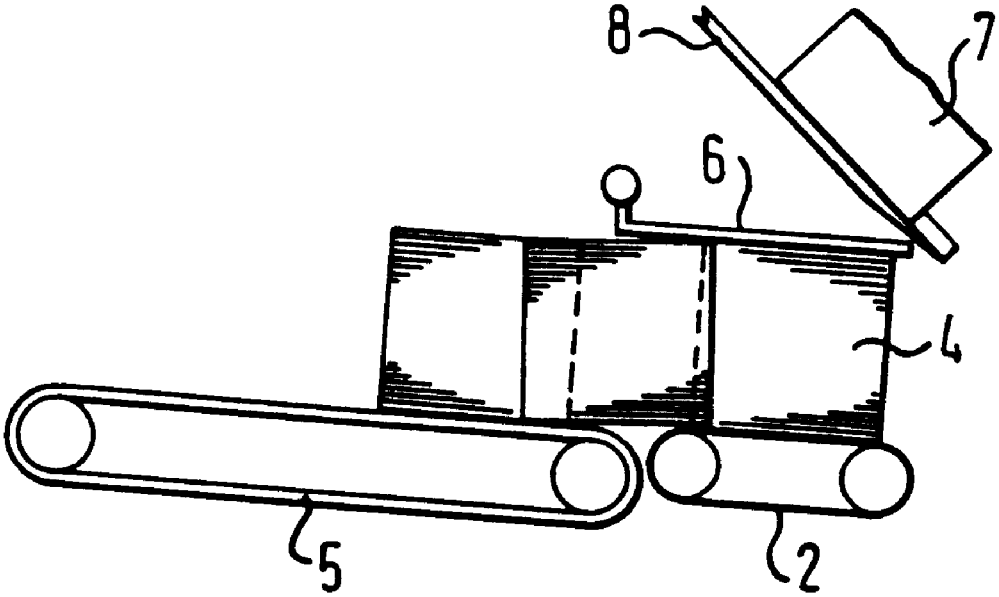

During this partial stack formation the finished stack 4 can be transferred from the portioning band 2 onto the transport band 5—as shown in FIG. 7—, the portioning band end of which has moved downwardly in accordance with the portioning band, so that a problem-free transfer of the finished stack 4 onto the transport band 5 is possible.

The stack formation procedure now repeats in the described manner.

Depending on the circumstances which are present in practice, the stack formation can take place free of empty cuts. However, it is naturally also possible to insert one empty cut or a few empty cuts between the termination of a stack formation and the start of a new partial stack formation. This does not change anything with respect to the advantageous basic principle of the present invention, which is to be seen in the special cooperation of the stack receiver and the portioning band.

What is claimed is:

1. An apparatus for forming stacks of slices of products cut up by a cutting device in a rapid sequence, the apparatus comprising:

a portioning band associated with the cutting device for conveying stacks of slices;

a stack receiver disposed between the cutting device and the portioning band and positioned in a slice stream to receive initial slices from the cutting device, the stack receiver being configured to be lowered in position during the stacking of the initial slices until a preset partial stack is formed, to transfer the preset partial stack to the portioning band, and to be returned to a waiting position close to the cutting device, so that subsequent slices from the cutting device are stacked on the portioning band increasing from the preset partial stack to a preset finished stack on the portioning band, wherein the portioning band is configured to be lowered during stacking of the slices at least between a partial stack take-over position upon receiving the preset partial stack from the stack receiver and a finished stack transfer position when the preset finished stack is formed on the portioning band; and a transport band which receives finished stacks of the slices from the portioning band;

wherein the stack receiver is configured to be moved out of the waiting position into the slice stream for receiving a next group of initial slices when the preset finished stack is formed on the portioning band.

2. An apparatus in accordance with claim 1 wherein the portioning band can be acceleratedly lowered for a short time to enlarge a shoot-in gap for shooting the stack receiver into the slice stream upon forming the preset finished stack on the portioning band.

3. An apparatus in accordance with claim 1 wherein the cutting device is a knife and the stack receiver is disposed at the beginning of receiving the initial slices with a knife side end in immediate vicinity of the lowest position of a cutting edge of the knife.

4. An apparatus in accordance with claim 1 wherein a ratio of the size of the lowering stroke of the stack receiver and of the portioning band is adjustable.

5. An apparatus in accordance with claim 1 wherein the lowering stroke of the stack receiver is fixed and the lowering stroke of the portioning band is adjustable in dependence on the respectively required stack height.

6. An apparatus in accordance with claim 1 wherein sequential stacks are formed and transferred to the transport band free of empty cuts for the cutting device.

* * * * *

UNITED STATES PATENT AND TRADEMARK OFFICE

CERTIFICATE OF CORRECTION

PATENT NO. : 6,152,004
DATED : November 28, 2000
INVENTOR(S) : Thomas Nispel

It is certified that error appears in the above-identified patent and that said Letters Patent is hereby corrected as shown below:

Title page,
Item [73] Assignee, change "Bioforce Anstalt" to -- Biforce Anstalt --

Signed and Sealed this

Eighth Day of January, 2002

*Attest:*

*Attesting Officer*

JAMES E. ROGAN
*Director of the United States Patent and Trademark Office*